United States Patent [19]

Hoyer

[11] Patent Number: 4,655,015

[45] Date of Patent: Apr. 7, 1987

[54] ANCHOR TIE FOR CARRYING PREFABRICATED CONCRETE MEMBERS

[75] Inventor: Peter Hoyer, Memmingen, Fed. Rep. of Germany

[73] Assignee: Firma Pfeifer Seil-und Hebetechnik GmbH & Co., Memmingen, Fed. Rep. of Germany

[21] Appl. No.: 838,885

[22] Filed: Mar. 11, 1986

Related U.S. Application Data

[63] Continuation of Ser. No. 593,569, Mar. 26, 1984, abandoned.

[30] Foreign Application Priority Data

Apr. 7, 1983 [DE] Fed. Rep. of Germany ..... 3312458

[51] Int. Cl.[4] ..... E04B 1/38

[52] U.S. Cl. ..... 52/125.4; 52/378; 52/698; 52/713

[58] Field of Search ..... 52/125.4, 125.5, 378, 52/379, 698, 699, 704–709, 713, 787, 712

[56] References Cited

U.S. PATENT DOCUMENTS

| | | | |
|---|---|---|---|
| 1,510,978 | 10/1924 | Conklin | 411/400 |
| 2,183,712 | 12/1939 | Dunlap | 52/379 |
| 2,627,176 | 2/1953 | Levy | 52/704 |
| 2,878,668 | 3/1959 | Starling et al. | 52/698 |
| 4,079,983 | 3/1978 | Van Mastrigt | 294/89 |
| 4,084,362 | 4/1978 | Piazza | 52/705 |
| 4,117,643 | 10/1978 | Lamothe | 52/704 |
| 4,120,128 | 10/1978 | Pauls | 52/704 |
| 4,202,951 | 4/1981 | Hoyer | 52/125.4 |
| 4,351,139 | 9/1982 | Gander | 52/378 |
| 4,528,791 | 7/1985 | Enssle | 52/699 |

FOREIGN PATENT DOCUMENTS

| | | | |
|---|---|---|---|
| 160939 | 8/1952 | Australia . | |
| 163292 | 8/1952 | Australia . | |
| 166278 | 8/1952 | Australia . | |
| 254682 | 3/1963 | Australia | 52/698 |
| 2704612 | 8/1978 | Fed. Rep. of Germany | 52/706 |
| 7504 | 11/1893 | Switzerland | 52/704 |
| 264835 | 6/1927 | United Kingdom | 52/698 |

*Primary Examiner*—John E. Murtagh
*Assistant Examiner*—Andrew Joseph Rudy
*Attorney, Agent, or Firm*—Holman & Stern

[57] ABSTRACT

The invention relates to an anchor tie member for use in carrying prefabricated concrete components, comprising a threaded portion for connecting the tie member to a lifting device and a tie rod having two end portions the first of which is secured to said threaded portion and the second of which is shaped so as to form at least one undulation therein. The arcuate shapes may be produced by a cold forming method and the presence of the undulation prevents the anchor tie from tearing out of the concrete while it is being transported and ensures a large breakout cone such that considerable forces may be withstood.

2 Claims, 1 Drawing Figure

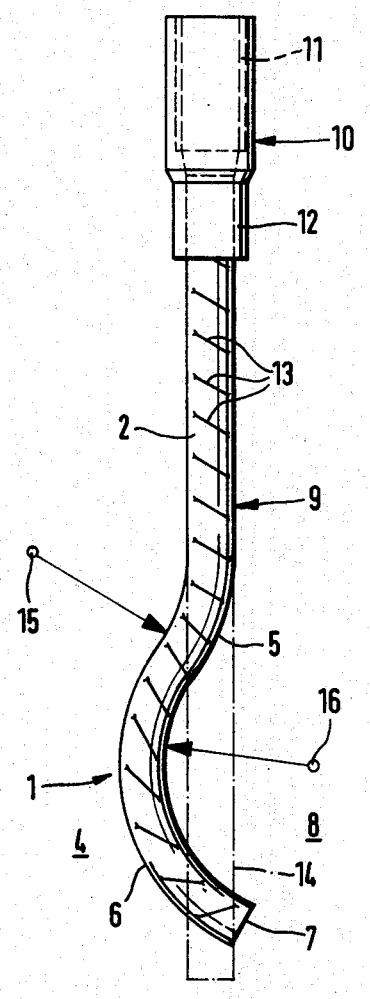
11
10
12
13
2
9
15
5
16
1
4
8
14
6
7

ANCHOR TIE FOR CARRYING PREFABRICATED CONCRETE MEMBERS

This is a contiuation of application Ser. No. 593,569 filed Mar. 26, 1984, now abandoned.

BACKGROUND OF INVENTION

The invention relates to an anchor-tie for carrying prefabricated concrete components.

An anchor tie of the above type is known for example from West German Offenlegungsschrift No. 19 13 912. In this anchor tie, there is a threaded part in the form of an internally threaded sleeve into which a rope loop can be screwed. The loop of rope is for connection with a lifting mechanism, which may, for example, be the hook of a crane. Instead of the loops of rope, it is possible to use other elements, such as, for example, eyebolts or similar.

The end of tie-rod, which may have rolled ribbing on its surface, is forced into the sleeve which is internally threaded at its outer end portion.

Another purpose of the threaded part of an anchor tie of this type is to secure the tie in the framework in which the concrete fabrication is produced. This ensures the correct positioning of the anchor tie.

It is known that the tie-rod can be made in various ways. For example, it is possible to use a bar of such length as to permit reliable transfer of forces to the concrete. As a rule, however, it transpires that relatively long lengths of rod are necessary for this.

If the tie-rod has, for example, a dish-shaped thickened portion, or a hook-shaped bend at its inner end, then the required length of rod can be reduced, since these devices improve the holding in the concrete to such an extent that the rod cannot readily be torn straight out. In the event of overloading, a cone-shape is far more likely to break out of the fabrication.

The provision of a thickened portion, for example by upsetting, is as a rule relatively expensive. If a hook shaped bend is to be produced, this presents the problem that certain radii cannot be exceeded when cold-forming steel if one is to avoid the material of the rod being damaged as a result of the flexing action. Thus, a relatively large expansion perpendicular to the axis of the rod is permitted by a bent hook.

Now, if an anchor tie of this type is used in thin walled concrete fabrications, the plane of the hook can be adjusted in relation to the plane of the wall, but it is necessary to screw the anchor tie with its threaded part onto a corresponding bolt in the framework. The amount of space required by the hook proves very inconvenient when performing this fastening operation.

It is apparent that the carrying member must transfer very considerable forces during transportation of the concrete fabrication from the place of manufacture to the point of assembly, but after that the carrying member is no longer needed. It is therefore a 'disposable' component which is required in great numbers and has therefore to be produced cheaply. DIN 529 describes masonry bolts which on the surface have a certain similarity to the construction of an anchor-tie.

However, in contrast with anchor ties for carrying masonry bolts are not used in the transportation of concrete fabrications, but are used at a later stage in the finished structure in bored-out holes and secured with mortar or some similar substance. Masonry bolts regularly break out of the hole with the plug of mortar in the event of overloading.

In the case of masonry bolts, various forms of anchorage elements are known which nevertheless are produced in relatively expensive forging operations.

BRIEF DESCRIPTION OF THE INVENTION

The aim of the invention is to produce a carrying member of the type described at the begining of this specification in such a way that, with a minimum consumption of material and as little expenditure as possible on production costs, a reliable connection between the threaded part and the concrete fabrication is obtained, but that the amount of space required at right angles to the longitudinal axis of the tie-rod remains small.

To achieve this aim, the invention provides an anchor tie member for use in carrying prefabricated concrete components, comprising a threaded portion for connecting the tie member to a lifting device and a tie rod having two end portions the first of which is secured to said threaded portion and the second of which is shaped so as to form at least one undulation therein. Whereas formerly, with rod-shaped tie-rods, only relatively long straight rods or hooked bends have been used, the invention takes as a basic assumption the fact that, by providing an undulation near the end of the rod, it is possible to achieve the same effect as can be achieved with a thickened portion produced by upsetting. The advantage of the undulation lies in the fact that the undulation can be produced by cold forming, although, naturally forming under elevated temperature conditions is also possible.

Thus, cold forming is possible because even in the case of comparatively large curvature radii, it is possible to obtain such anchorage in the concrete prefabrication that the tie-rod can no longer be torn out as a straight plug, but, in the event of overloading, a 'fracture cone' always forms. Laterally, the amount of space required by the undulation is then very small, with the result that the above-mentioned fastening operations can be carried out even when the space is extremely restricted.

It is surprising that with the invention the material requirement for the tie-rod is very small; as a rule, it is smaller than for the known hooked elements.

In an example of the invention, it is proposed that the bend comprises only a single undulation. In particular, it is proposed that the undulation consists of a bend to to one side beginning at the straight part of the tie-rod and having a relatively short arc, followed by another bend in the opposite direction having an arc of such a length that the end of the tie-rod extends to the other side. It is preferable and possible for the two arcs to follow directly one after the other.

It has been found that it is sufficient for the invention if the curvatures have a lateral dimension of approximately one or two times the diameter of the tie-rod. It is clear that the small sideways curvature represents a considerable advantage both as regards the production of the carrying member and as regards the space requirements.

BRIEF DESCRIPTION OF THE DRAWINGS

The drawing shows a side view of one example of the invention.

DETAILED DESCRIPTION OF THE DRAWING

The carrying member shown comprises the threaded part 10 and the tie-rod 9. In the example illustrated, the threaded part is in the form of a sleeve with an internal thread 11 in one part which serves to connect it to the lifting device (not shown). The other part 12 of the internal bore serves to connect it to the tie-rod 9 which is connected to the threaded part by means of external radial pressure. Although the form of threaded part illustrated represents the preferred variant of the invention, the threaded part illustrated can also be replaced by other threaded parts for example bolts or similar components. The pressure connection in the part 12 of the internal bore is convenient for the invention, but it can also be replaced by other fastenings, for example a welded joint or the like.

The tie-rod 9 is made from a straight bar of concrete steel which has ribs 13 on its surface, produced, for example, by rolling. The anchorage in the concrete is improved by these ribs 13 as is well known. However, the invention can also be used in relation to those tie-rods which have relatively smooth external surfaces or some other profile. The connection with the threaded part 10 may also be improved by the ribs 13.

A cold forming process is applied to produce a short arc 5 in the straight portion 2 of the straight rodshaped tie-rod, the original shape of which is indicated by the broken lines 14. The relevant centre of curvature is denoted by 15. Following on the short arc 1 is a longer arc 6, of which the centre of curvature is denoted by 16. In this way, the tip 7 arrives at the side 8 of the carrying member, whilst the main part of the curvature 1 runs along the other side 4. The other side 4 being diametrically opposite to said side 8 by 180°.

In the example illustrated, the tip 7 only slightly protrudes on the side 8, whereas the curvature on the side 4 amounts to approximately one and a half times the diameter of the tie-rod. It has been found that such a design fully meets all demands. Obviously, it is possible to make the space requirement on both sides 4 and 8 the same. But an additional length of rod at the tip 7 does not have any particular advantage since the side of the break out cone is not significantly improved by this.

In the example illustrated, the undulations are arranged in a single plane, and as a rule this is sufficient for the aims of the invention. But it is nevertheless within the scope of the invention to provide the undulations in several planes, if desired.

I claim:

1. An anchor tie member for use in carrying prefabricated concrete components, consisting essentially of a threaded portion for connecting the tie member to a lifting device and a tie rod having a diameter and two end portions, the first portion of which is linear and secured to said threaded portion and the second of which is shaped by cold forming with an undulation therein having only first and second bends, the first bend being located external one side of the the diameter of the first portion of the the rod, said first bend describing a relatively short arc, and a second bend extending from the first bend in an opposite direction to the first bend, said second bend describing a relatively long arc on which a tip of the rod is located, the tip of the rod being positioned beyond another side , said another side being diametrically opposite to said one by 180°, of the said first portion of the rod to that of the first bend and the second bend having a depth from one to two times the diameter of the rod.

2. An anchor tie member as claimed in claim 1, wherein the undulation is in one plane only.

* * * * *